US011858680B2

(12) United States Patent
Palmer et al.

(10) Patent No.: US 11,858,680 B2
(45) Date of Patent: Jan. 2, 2024

(54) CONTAINER AND METHOD OF MANUFACTURING THE SAME

(71) Applicant: Altium Packaging LP, Atlanta, GA (US)

(72) Inventors: Joe Palmer, Marietta, GA (US); Dena Wade, Atlanta, GA (US)

(73) Assignee: ALTIUM PACKAGING LP, Atlanta, GA (US)

( * ) Notice: Subject to any disclaimer, the term of this patent is extended or adjusted under 35 U.S.C. 154(b) by 48 days.

(21) Appl. No.: 17/144,760

(22) Filed: Jan. 8, 2021

(65) Prior Publication Data

US 2021/0214116 A1 Jul. 15, 2021

Related U.S. Application Data

(60) Provisional application No. 62/960,985, filed on Jan. 14, 2020.

(51) Int. Cl.
*B65D 1/44* (2006.01)
*B65D 1/02* (2006.01)

(52) U.S. Cl.
CPC ..... *B65D 1/44* (2013.01); *B65D 1/023* (2013.01); *B65D 1/0284* (2013.01); *B65D 2501/0027* (2013.01)

(58) Field of Classification Search
CPC ..... B65D 2501/0027
See application file for complete search history.

(56) References Cited

U.S. PATENT DOCUMENTS

D28,225 S 2/1898 Cushman
D62,888 S 8/1923 Davis, Jr. et al.
(Continued)

FOREIGN PATENT DOCUMENTS

CN 202054192 U 11/2011
CN 104443622 A 3/2015
(Continued)

OTHER PUBLICATIONS

NonFinal Office Action for U.S. Appl. No. 17/039,320, dated Sep. 1, 2021, (14 pages), United States Patent and Trademark Office, USA.

(Continued)

*Primary Examiner* — Ernesto A Grano
*Assistant Examiner* — Symren K Sanghera
(74) *Attorney, Agent, or Firm* — Alston & Bird LLP

(57) ABSTRACT

A container may comprise a tubular body having a longitudinal axis and a rounded sidewall; a base portion; a rim portion; a vertical portion defined, in part, by the rounded sidewall, aligned along the longitudinal axis, and extending between the base portion and the rim portion; a plurality of grooves defined within the vertical portion, each of the grooves comprising a width defining opposing sides of each of the plurality of grooves, wherein: each of the plurality of grooves is aligned parallel with the longitudinal axis; the valley of each of the plurality of grooves is radially inset a distance from the vertical portion perimeter; and opposing sides of adjacently positioned ones of the plurality of grooves define a peak that is radially aligned with the vertical portion perimeter. The container may also comprise a set of base transition grooves extending between the base portion and the vertical portion and aligned parallel with the longitudinal axis.

20 Claims, 10 Drawing Sheets

(56) References Cited

U.S. PATENT DOCUMENTS

D67,874 S 7/1925 Bromley
D95,419 S 4/1935 Grey
D101,741 S 10/1936 Klein
D111,794 S 10/1938 Oswell
D112,381 S 11/1938 Sauer, Jr.
D164,964 S 10/1951 Serra
2,953,271 A 9/1960 Hohl et al.
D193,741 S 10/1962 Westhoven et al.
D195,697 S 7/1963 Price
D197,190 S 12/1963 Natale et al.
D200,672 S 3/1965 Swayze
D200,792 S 4/1965 Eyles et al.
D201,051 S 5/1965 Shepler
D201,103 S 5/1965 Caisse
D203,560 S 1/1966 Erickson et al.
D204,701 S 5/1966 Shepler
D208,824 S 10/1967 Platte
D213,821 S 4/1969 Platte
D215,410 S 9/1969 Hills
D221,515 S 8/1971 Betka
D222,340 S 10/1971 Weckman et al.
D229,296 S 11/1973 Cutler
D238,654 S 2/1976 Platte
D241,013 S 8/1976 Dekker et al.
D250,995 S 2/1979 Beaver
D264,435 S 5/1982 Pettengill
D264,436 S 5/1982 Pettengill
D264,813 S 6/1982 Potter
4,372,455 A 2/1983 Cochran
4,447,974 A * 5/1984 Vicino ..... G09F 1/08 40/538
D286,000 S 10/1986 Bussell
D286,379 S 10/1986 Lyons
D309,421 S 7/1990 Aldrich, III
4,964,522 A 10/1990 Umetsu et al.
D322,936 S 1/1992 Maginnis, Jr.
D348,612 S 7/1994 Ring
D356,264 S 3/1995 Praturlon et al.
D356,265 S 3/1995 Moloney et al.
D368,035 S 3/1996 Ahern, Jr.
D379,929 S 6/1997 Dallaire
D380,647 S 7/1997 Durand
D391,854 S 3/1998 Ankney et al.
5,735,421 A 4/1998 Deemer et al.
5,833,115 A 11/1998 Eiten
D408,292 S 4/1999 Gundlach et al.
D421,393 S 3/2000 Pavely et al.
6,068,161 A 5/2000 Soehnlen et al.
D427,076 S 6/2000 Ankney et al.
D428,817 S 8/2000 Olson et al.
6,220,475 B1 4/2001 Nayar et al.
6,237,792 B1 5/2001 Skolnicki et al.
6,264,053 B1 * 7/2001 Slat ..... B65D 23/102 215/382
D470,417 S 2/2003 Anderson
6,527,133 B1 3/2003 McCollum et al.
6,588,612 B1 7/2003 Dorn et al.
D485,497 S 1/2004 Steele, IV et al.
D488,721 S 4/2004 Peronek
6,889,858 B2 5/2005 McCollum et al.
D514,949 S 2/2006 Dalton et al.
D522,879 S * 6/2006 Chadfield ..... D9/727
7,059,486 B2 6/2006 Van Der Heijden et al.
D528,003 S 9/2006 Livingston
D538,166 S 3/2007 Bertin et al.
D539,156 S 3/2007 Fraser et al.
D559,692 S 1/2008 Floyd et al.
D593,863 S 6/2009 Fahy et al.
D611,826 S 3/2010 Kuroki et al.
7,686,168 B1 3/2010 Smiley et al.
7,699,171 B2 4/2010 Rivera et al.
D622,604 S * 8/2010 Wheeler ..... D9/556
7,789,255 B2 9/2010 Zoppas
8,047,392 B2 11/2011 Eiten et al.
D652,729 S 1/2012 Young et al.
D662,421 S 6/2012 Dorn
8,276,775 B2 10/2012 Boukobza
D678,072 S 3/2013 Lobbestael et al.
D685,641 S 7/2013 Tomkins et al.
D686,080 S 7/2013 Tomkins et al.
D694,622 S 12/2013 Bulens
8,668,101 B2 3/2014 Lobbestael et al.
8,714,385 B2 5/2014 Jung et al.
8,893,908 B2 11/2014 Treece et al.
8,979,524 B2 3/2015 Lobbestael et al.
D733,566 S 7/2015 Lobbestael et al.
D739,248 S 9/2015 Janeczek
D742,747 S 11/2015 Lobbestael et al.
9,446,551 B2 9/2016 Lobbestael et al.
D800,567 S 10/2017 Palmer et al.
D805,909 S * 12/2017 Matsuishi ..... D9/558
9,981,768 B1 5/2018 Joey et al.
D823,690 S 7/2018 Palmer et al.
D823,691 S 7/2018 Palmer et al.
D825,992 S * 8/2018 Sadhwani ..... D7/510
10,384,824 B2 8/2019 Palmer et al.
D874,284 S 2/2020 Palmer et al.
D874,940 S 2/2020 Janeczek et al.
D903,420 S 12/2020 Kander
D908,433 S * 1/2021 Sapire ..... D9/556
11,027,884 B2 6/2021 Manderfield et al.
D932,311 S 10/2021 Manderfield et al.
D964,175 S 9/2022 Rentz Henry et al.
D968,229 S 11/2022 Palmer et al.
D980,071 S 3/2023 Yee
2002/0153343 A1 10/2002 Tobias et al.
2003/0006210 A1 1/2003 Iizuka et al.
2003/0155324 A1 8/2003 McCollum et al.
2003/0230545 A1 12/2003 Mount et al.
2004/0094502 A1 5/2004 Boukobza
2004/0164047 A1 * 8/2004 White ..... B65D 1/32 215/382
2005/0082251 A1 4/2005 Dan et al.
2005/0127024 A1 6/2005 Darr
2006/0260971 A1 11/2006 Rivera et al.
2007/0023384 A1 2/2007 Janeczek
2010/0089863 A1 4/2010 Matsuoka
2011/0132863 A1 6/2011 Dorn
2011/0226788 A1 9/2011 Yourist
2011/0284541 A1 11/2011 Webster et al.
2012/0241405 A1 9/2012 Lobbestael et al.
2013/0001234 A1 1/2013 Glover
2014/0197127 A1 7/2014 Lane et al.
2014/0326695 A1 * 11/2014 Paredes ..... B65D 1/0223 215/382
2015/0014274 A1 1/2015 Glover
2016/0167822 A1 6/2016 Oostwouder
2016/0272356 A1 9/2016 Simpson et al.
2017/0158370 A1 6/2017 Kuhar et al.
2017/0305590 A1 10/2017 Grabher
2018/0244423 A1 8/2018 Palmer et al.
2019/0193890 A1 6/2019 Palmer et al.
2019/0210758 A1 7/2019 Casper et al.
2020/0231335 A1 * 7/2020 Manderfield ..... B65D 25/2897
2021/0261298 A1 8/2021 Manderfield et al.

FOREIGN PATENT DOCUMENTS

DE 2062684 A1 7/1972
DE 7505888 U 7/1975
FR 1300440 A 8/1962
FR 3022896 A1 1/2016
JP 2017119543 A 7/2017
WO WO 1998/033712 A1 8/1998
WO WO-2018/037052 A1 3/2018

OTHER PUBLICATIONS

Non Final Office Action for U.S. Appl. No. 29/799,833, dated Oct. 5, 2021, (17 pages), United States Patent and Trademark Office, USA.

(56) References Cited

OTHER PUBLICATIONS

Notice of Allowance and Issue Fee(s) Due for U.S. Appl. No. 29/698,691, dated Jun. 3, 2021, (8 pages), United States Patent and Trademark Office, USA.
Notice of Allowance and Fee(s) Due for U.S. Appl. No. 29/799,833, dated Nov. 24, 2021, (9 pages), United States Patent and Trademark Office, USA.
Supplemental Notice of Allowability for a Design Application for U.S. Appl. No. 29/799,833, dated Dec. 8, 2021, (6 pages), United States Patent and Trademark Office, USA.
Final Office Action for U.S. Appl. No. 17/039,320, dated Dec. 13, 2021, (11 pages), United States Patent and Trademark Office.
International Searching Authority, International Search Report and Written Opinion for International Application No. PCT/US2021/012586, dated May 4, 2021, (13 pages), European Patent Office, Rijswijk, Netherlands.
Notice of Allowance and Fee(s) Due for U.S. Appl. No. 29/692,723, dated Apr. 6, 2021, (17 pages), United States Patent and Trademark Office, USA.
Notice of Allowance and Fee(s) Due for U.S. Appl. No. 16/252,082, dated Apr. 14, 2021, (10 pages), United States Patent and Trademark Office, USA.
Canadian Intellectual Property Office, Examiner's Report for Application No. 181964, dated Jul. 23, 2018, 2 pages, Canada.
Canadian Intellectual Property Office, Requisition by the Examiner for Application No. 3,009,203, dated Sep. 6, 2018, 3 pages, Canada.
European Union Intellectual Property Office, Examination Report for Application Nos. 005316882-0001/005316882-0003, dated Aug. 14, 2018, 1 page, Spain.
International Searching Authority, Invitation to Pay Additional Fees for Application No. PCT/US2017/047891, dated Nov. 2, 2017, (14 pages), European Patent Office, Netherlands.
International Searching Authority, International Search Report and Written Opinion for Application No. PCT/US2017/047891, dated Jan. 5, 2018, (21 pages), European Patent Office, Netherlands.
International Search Report and Written Opinion for International Application No. PCT/US2020/013520, dated Jul. 1, 2020, (12 pages), Rijswijk, Netherlands.
Office Action for U.S. Appl. No. 15/255,403, dated Sep. 29, 2017, (9 pages), United States Patent and Trademark Office, USA.
Notice of Allowance for U.S. Appl. No. 15/255,403, dated Mar. 5, 2018, (10 pages), United States Patent and Trademark Office, USA.
NonFinal Office Action for U.S. Appl. No. 16/252,082, dated Jul. 8, 2020, (21 pages), United States Patent and Trademark Office, USA.
Final Office Action for U.S. Appl. No. 16/252,082, dated Jan. 21, 2021, (17 pages), United States Patent and Trademark Office, USA.
Notice of Allowance for U.S. Appl. No. 29/765,514, dated Jul. 22, 2022, (24 pages), United States Patent and Trademark Office, US.
Vintage ROUND Amber glass poison bottle embossed "Not to Be Taken," Online, (published date unknown), [Retrieved from the Internet Jul. 7, 2022] <URL: https://www.ebay.com/itm/402822535120?_trkparms=amclksrc%3DITM%26aid%3D111001%26algo%3DREC.SEED%26ao%3D1%26asc%3D20180105095853%26meid%3D33267f8a2cb24016b461c2186ed7f887%26pid%3D10>.
NonFinal Office Action for U.S. Appl. No. 17/314,880, dated Dec. 22, 2022, (21 pages), United States Patent and Trademark Office, US.
Canadian Office Action for Canadian Patent Application No. 3,117,896, dated Jan. 9, 2023, (4 pages), Canadian Intellectual Property Office, Quebec, Canada.
Notice of Allowance and Fee(s) Due for U.S. Appl. No. 29/852,782, dated Apr. 10, 2023, (8 pages), United States Patent and Trademark Office, US.
Altium Packaging, "Altium Packaging's Dura-Lite® Family of Bottles Reaches Major Milestone," BusinessWire, published Mar. 12, 2020, (3 pages), available online, [Retrieved from the Internet May 4, 2023] <URL: https://www.businesswire.com/news/home/20200512005499/en/Altium-Packaging%E2%80%99s-Dura-Lite%C2%AE-Family-of-Bottles-Reaches-Major-Milestone.
Final Office Action for U.S. Appl. No. 17/314,880, dated May 24, 2023, (15 pages), United States Patent and Trademark Office, US.

* cited by examiner

CONTAINER AND METHOD OF MANUFACTURING THE SAME

CROSS-REFERENCE TO RELATED APPLICATIONS

This application claims priority to and the benefit of U.S. Provisional Patent Application Ser. No. 62/960,985, filed Jan. 14, 2020; the entire contents of which as are hereby incorporated by reference in their entirety.

BACKGROUND

Containers that may be used to enclose and transport fluids, objects, or combinations of fluids and objects (e.g., disposable cleaning wipes) are often subject to significant stresses during use. Such containers may be dropped while full or partially full of fluid and/or objects, stacked on top of one another, supported in a suspended configuration (e.g., when held by a user), and/or the like. Accordingly, various containers incorporate strengthening features in order to provide strength to the container against breakage.

However, containers may be subject to additional limitations, such as a requirement to minimize the cost of materials in the containers, the weight of materials in the containers, and/or the like. Accordingly, container configurations often are subject to generally conflicting design considerations of maximizing the strength of the container while minimizing the cost and/or weight of materials in the container.

Accordingly, a need exists for containers providing an optimal balance of maximum strength against undesired breakage while minimizing the cost and/or weight of materials in the container.

BRIEF SUMMARY

Various embodiments are directed to high-strength blow-molded containers having a thin overall sidewall thickness. The container may be a cylindrical container particularly suitable for storing and transporting disposable cleaning wipes that may be stored in a rolled configuration. The container may have walls of a variable wall thickness imbedded with grooves configured to distribute axial compression loads over a large surface area of the container sidewalls to mitigate the damaging effects of crushing loads experienced by the container.

Various embodiments are directed to a container comprising: a tubular body having a longitudinal axis and a rounded sidewall extending between a first end and an opposite end surrounded by a rim portion; a base portion defined, in part, by the first end and configured to support the container in an upright orientation relative to a support surface, the base portion further defining a support ring having an at least substantially rounded perimeter; a rim portion defined, in part, by the opposite end and positioned opposite the base portion; a vertical portion defined, in part, by the rounded sidewall, aligned along the longitudinal axis, and extending between the perimeter of the base portion and the rim portion, the vertical portion having a first diameter that defines a vertical portion perimeter; and a plurality of grooves defined within the vertical portion of the rounded sidewall, each of the grooves comprising a width defining opposing sides of each of the plurality of grooves, a length greater than the width and defining opposing ends of each of the plurality of grooves, and a center defining a valley of each of the plurality of grooves intermediate the opposing sides, wherein: each of the plurality of grooves is aligned parallel with the longitudinal axis; the valley of each of the plurality of grooves is radially inset a distance from the vertical portion perimeter; and opposing sides of adjacently positioned ones of the plurality of grooves define a peak that is radially aligned with the vertical portion perimeter.

In certain embodiments, the sidewall defines an at least substantially uniform wall thickness through the vertical portion. In certain embodiments, the rounded sidewall further defines a curved base transition region extending between the base portion and the vertical portion. In certain embodiments, the curved base transition region defines one or more base transition grooves arranged around the perimeter of the curved base transition region and extending at least partially between the base portion and the vertical portion and following a length of a radius of the base portion. In certain embodiments, the one or more base transition grooves are aligned with respective ones of the plurality of grooves defined within the vertical portion of the rounded sidewall. In certain embodiments, the plurality of grooves defined within the vertical portion and the one or more base transition grooves are arranged around a perimeter of the vertical portion and the curved base transition region, respectively. In certain embodiments, a portion of the vertical portion is inset relative to the curved base transition region.

In certain embodiments, the base portion defines a base channel extending across the base portion and aligned with a diameter of the base portion, wherein the base channel has a depth extending toward an interior of the container. In certain embodiments, the rounded sidewall further defines a curved base transition region extending between the base portion and the vertical portion; the curved base transition region defines one or more base transition grooves arranged around the perimeter of the curved base transition region and extending at least partially between the base portion and the vertical portion and following a length of a radius of the base portion; and the base channel extends along the diameter of the base portion and at least partially intersects a portion of one or more of the one or more base transition grooves. In certain embodiments, the base portion defines a rounded inset panel oriented such that the centerline of the rounded inset panel is aligned with the centerline of the base portion, wherein the depth of the base channel is a first depth, and the rounded inset panel has a second depth extending towards the interior of the container, wherein the second depth is greater than the first depth.

In certain embodiments, the rim portion is oriented such that a centerline of the rim portion is aligned with a centerline of the base portion, the rim portion comprising an outer perimeter defining an at least substantially rounded perimeter; and an inner perimeter defining an at least substantially rounded perimeter of an opening, wherein the opening is oriented such that a centerline of the opening is aligned with the centerline of the base portion. In certain embodiments, adjacent ones of the plurality of grooves on the vertical portion and the one or more base transition grooves are each separated by substantially the same distance along respective lengths of the grooves. In certain embodiments, the grooves of at least two of the base transition grooves are configured to intersect the base channel.

According to various embodiments yet another container is provided, comprising a tubular body having a longitudinal axis and a rounded sidewall extending between a first end and an opposite end surrounded by a rim portion; a base portion defined, in part, by the first end and configured to support the container in an upright orientation relative to a support surface, the base portion further defining a support ring having an at least substantially rounded perimeter; a rim portion defined, in part, by the opposite end and positioned opposite the base portion; a vertical portion defined, in part, by the rounded sidewall and comprising a vertical portion aligned along the longitudinal axis and extending between the perimeter of the base portion and the rim portion, the vertical portion having a first diameter that defines a vertical portion perimeter; and a set of base transition grooves defined on a portion of the rounded sidewall, wherein: the portion of the rounded sidewall upon which the base transition grooves is defined is a curved base transition region extending between the base portion and the vertical portion; and each of the base transition grooves is aligned parallel with the longitudinal axis.

In certain embodiments, the set of base transition grooves is arranged around the perimeter of the curved base transition region and extending at least partially between the base portion and the vertical portion and following a length of a radius of the base portion.

In certain embodiments, the container further comprises a plurality of grooves defined within the vertical portion of the rounded sidewall, each of the grooves comprising a width defining opposing sides of each of the plurality of grooves, a length greater than the width and defining opposing ends of each of the plurality of grooves, and a center defining a valley of each of the plurality of grooves intermediate the opposing sides, each of the plurality of grooves is aligned parallel with the longitudinal axis; and the set of base transition grooves is aligned with respective ones of the plurality of grooves defined within the vertical portion of the rounded sidewall. In certain embodiments, the valley of each of the plurality of grooves is radially inset a distance from the vertical portion perimeter; and opposing sides of adjacently positioned ones of the plurality of grooves define a peak that is radially aligned with the vertical portion perimeter.

In certain embodiments, the sidewall defines an at least substantially uniform wall thickness through the vertical portion. In certain embodiments, the base portion defines a base channel extending across the base portion and aligned with a diameter of the base portion, wherein the base channel has a depth extending toward an interior of the container. In certain embodiments, the base channel extends along the diameter of the base portion and at least partially intersects a portion of one or more of the one or more base transition grooves.

BRIEF DESCRIPTION OF THE SEVERAL VIEWS OF THE DRAWINGS

Reference will now be made to the accompanying drawings, which are not necessarily drawn to scale, and wherein.

DETAILED DESCRIPTION

Figure 1:
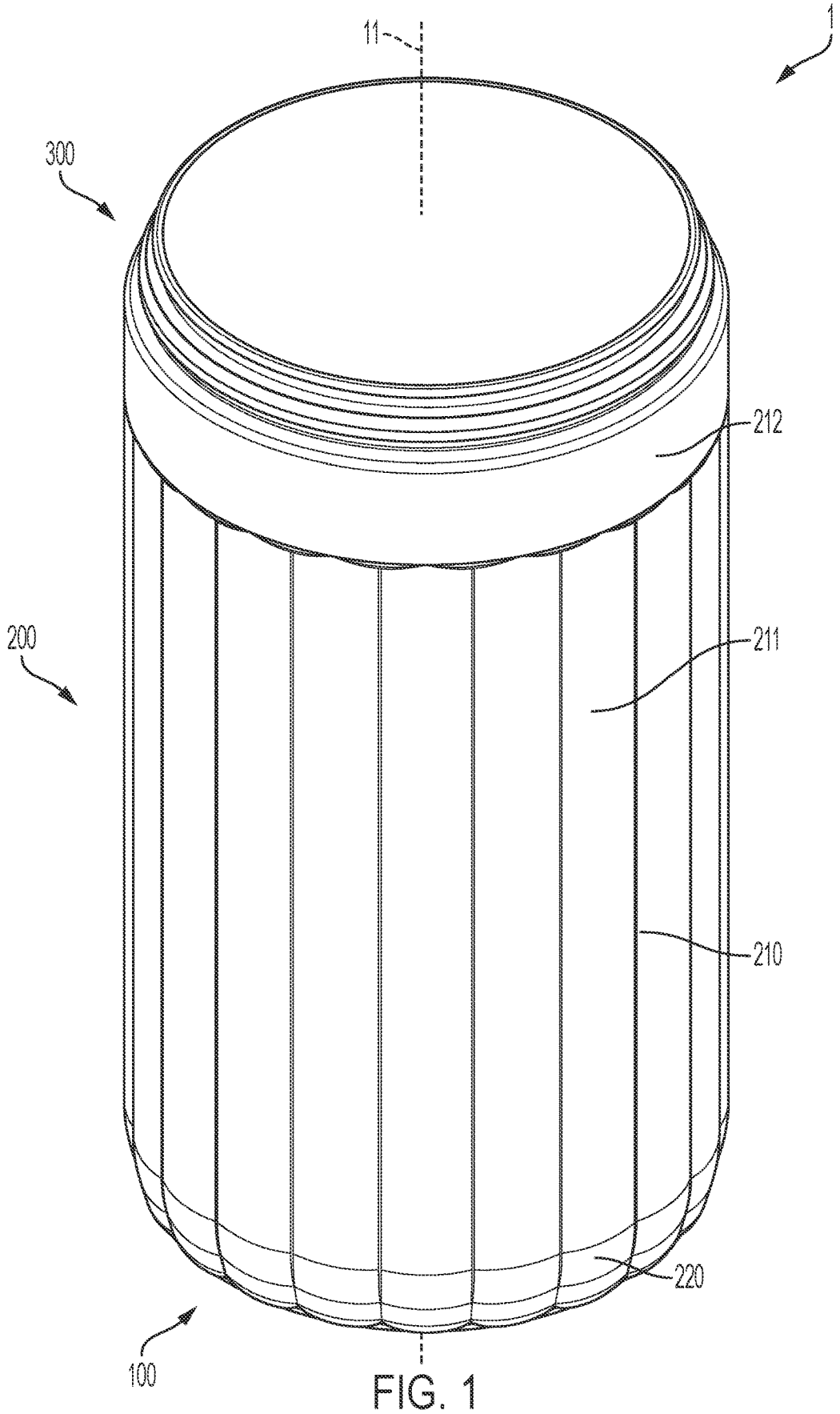
FIG. 1 shows a perspective view of a container according to various embodiments.

The present invention will now be described more fully hereinafter with reference to the accompanying drawings, in which some, but not all embodiments of the invention are shown. Indeed, the invention may be embodied in many different forms and should not be construed as limited to the embodiments set forth herein. Rather, these embodiments are provided so that this disclosure will satisfy applicable legal requirements. Like numbers refer to like elements throughout.

Overview

Described herein is a container configured to, as a non-limiting example, enclose disposable cleaning wipes. The container comprises a plurality of strengthening features that provide desirable strength characteristics while minimizing the required amount of material necessary to construct the container having the desired strength characteristics. For example, various strengthening features may extend across planar surfaces, curved surfaces, and/or complex curved surfaces in order to provide crush resistance, tensile strength, and/or the like for the container. In various embodiments, the container may comprise a plastic material (e.g., High-Density Polyethylene (HDPE), Polyethylene terephthalate (PET), Polypropylene, or other thermoplastic polymers). As a non-limiting example, the container may comprise at least about 40-56 g of material to provide a container having an interior volume of at least substantially 64 oz. As a non-limiting example, the container may comprise at least about 22-28 g of material to provide a container having an interior volume of at least substantially 38 oz. Substantially larger or smaller containers may be formed or provided, with structural features beyond size/dimension otherwise as detailed herein.

As discussed herein, the container may define an at least substantially rounded base-perimeter having an at least substantially rounded sidewall extending therefrom. The sidewall may extend from a base portion, through a curved base transition region, and through a vertical portion to a rim portion. In certain embodiments, the sidewall may contain grooves, which grooves may extend through the curved base transition region and the vertical portion. In certain embodiments, the vertical portion may also have a degree of curvature along at least a portion thereof. In certain embodiments, the grooves may extend only partly along and/or around a portion of the vertical portion, defining smooth portions, which may be useful for adherence of labels or the like to the container. In certain embodiments, the grooves may extend only along and/or around a portion of the curved base transition region for similar or other considerations, aesthetic and/or structural (i.e., strength-providing) in nature. In certain embodiments, the grooves may extend through a portion of the vertical portion, ending influenced at least in part due to curvatures of other portions of the container(s). These and other various embodiments (including variations not illustrated herein) may be understood with reference collectively to FIGS. 1 and 7A-C. Any of a variety of combinations of those embodiments illustrated, as will be detailed elsewhere herein, may be also envisioned within the scope of the present invention.

The container may be extrusion blow molded. In various embodiments, the container may be formed by placing an extruded parison within a container mold having an interior surface corresponding to the shape of the container. The parison itself may be extruded via an extrusion head comprising a mandrel and corresponding die shaped to disperse molten plastic of the parison to minimize the thickness of a partline formed in the blowmolded container (as a result of the joining of two mold shells). In various embodiments, the container mold may comprise two mold shells that collectively define the entirety of the mold. The mold shells may be symmetrical and have corresponding features, and accordingly the resulting container may be symmetrical across one or more planes. The following description of a container is divided into various portions of the container for purposes of clarity, however it should be understood that such divisions should not construed as limiting, as one or more containers according to various embodiments may be constructed as a single continuous part. Moreover, the following description provides various dimensions for an example embodiment. These dimensions should not be construed as limiting and are instead provided as dimensions for just one example embodiment.

Container Construction

Figure 7A:
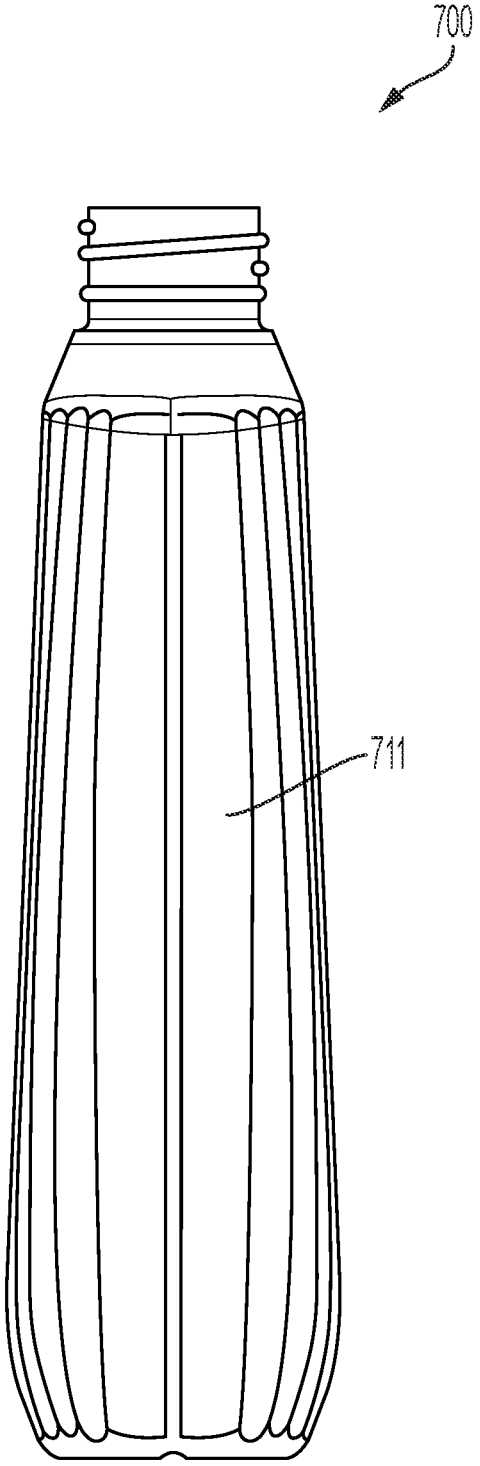
FIGS. 7A-C show side views of containers according to embodiments other than that illustrated in FIG. 1.
Figure 7B:
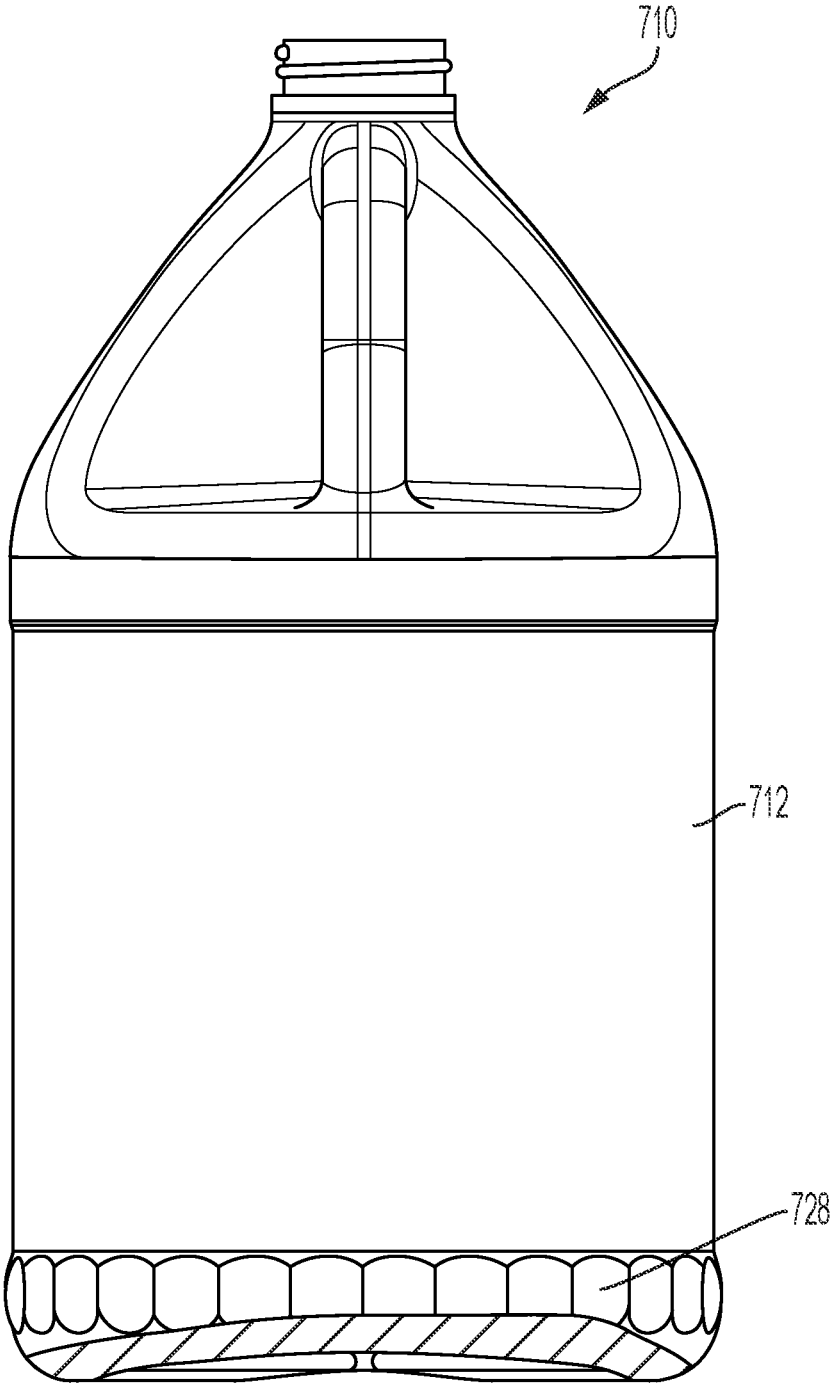

In various embodiments, as may be understood from FIG. 1, the container 1 may be generally cylindrical in shape. An additional embodiment is illustrated in FIG. 7A, wherein a container 700 in many ways analogous to the container 1 may have a column and/or tapered-column shape and/or not be cylindrically shaped (i.e., having different width versus depth). Yet another embodiment is illustrated in FIG. 7B, wherein a container 710 in many ways analogous to the container 1 may be shaped like a conventional round gallon carton for storing fluids, such as bleach, milk, or the like. In yet another embodiment illustrated in FIG. 7C, a container 720 also in many ways analogous to the container 1 may have a decanter shaped with multiple areas of tapering along a length or height thereof. In certain of these embodiments, the containers may be square, rectangular, oval, or irregularly shaped, with reference to respective base portions thereof. Other features of these additional embodiments, though, including but not limited to the sidewall and/or transition region grooves or flutes may be substantially the same as the features described with reference to the container 1.

Returning to FIG. 1, the container 1 illustrated therein may comprise a tubular body 10 having an open top end 12 (which may have a lid attached thereto) and an opposing and closed bottom end. The tubular body may be radially centered about a central axis 11. In various embodiments, the closed bottom end may be defined, at least in part, by a bottom portion 100 and the open top end may be defined by a rim portion 300. In various embodiments, the closed bottom end may be configured to interact with a supporting surface such that the closed bottom end may allow the container 1 to remain in an upright position. In various embodiments, the rim portion 300 may be configured for accepting a lid (not shown). The lid may be generally rounded in shape with a diameter at least substantially the same as an outer diameter of the tubular body. In such an embodiment, when attached to the rim portion 300, the lid may be radially centered about a central axis 11 and may cover at least a portion of the open top end 12.

Figure 5:
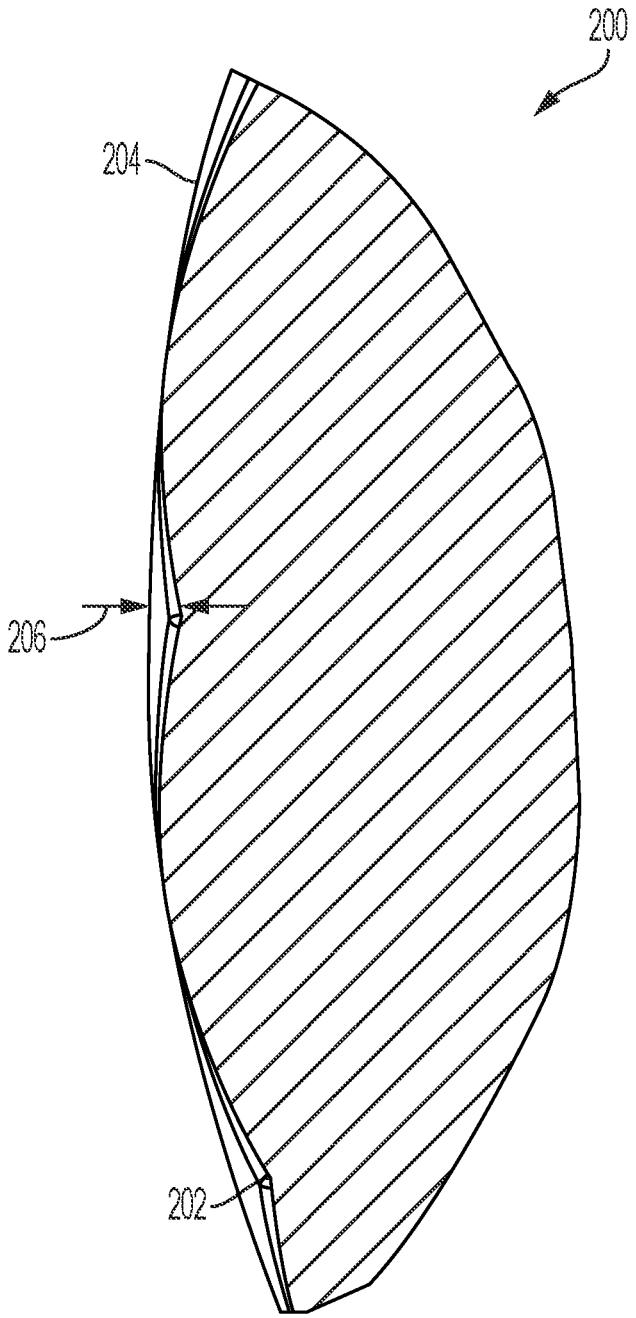
FIG. 5 shows an enlarged sectional view of the rounded sidewall of the container of FIG. 1 according to various embodiments.

In various embodiments, the container 1 may have a height of at least approximately 8.224 inches to 8.344 inches (e.g., about 8.284 inches). In certain embodiments, the height may range from 8 inches to 9 inches, although it should be understood that taller and/or shorter embodiments may be envisioned and still otherwise (e.g., grooves and transition regions) remain within the scope of other features of the container. In various embodiments, the container 1 may have a rounded sidewall 200, which may have an outer diameter 202 (see FIG. 5) of at least approximately 4.33 inches to 4.17 inches (e.g., about 4.25 inches, as illustrated in FIG. 5). In certain embodiments, the outer diameter 202 may range from 4 to 5 inches. In various embodiments, the open top end adjacent rim portion 300 may also have a diameter of at least approximately 3.79 inches to 3.76 inches (e.g., about 3.775 inches). In other embodiments, the diameter of the rim portion 300 may range from 3.5 to 4 inches. In still other embodiments, the diameter of the rim portion 300 may be substantially the same as the diameter of the rounded sidewall 200. As noted above however, larger or smaller containers may be provided in accordance with certain embodiments.

In various embodiments, the container 1 may comprise and/or be formed from a rigid or semi-rigid material. Semi-rigid containers 1 may be configured to flex when exposed to externally applied forces, and/or rigid containers 1 may be configured to resist substantial flexing when subject to externally applied forces. For example, the container 1 may comprise plastic or other rigid or semi-rigid material. As just one specific example, the container 1 may comprise HDPE. As will be discussed herein, the container may be extrusion blow molded. In such embodiments, the container 1 may comprise at least approximately 35 g of material to provide a 64-ounce interior volume container. As other example embodiments, the container 1 may comprise at least approximately 22-28 g (e.g., 25 g) of material for a 38-ounce interior volume container, and/or at least approximately 40-56 g (e.g., 52.5 g) of material for a 64-ounce interior volume container.

Except as otherwise discussed herein, the container 1 may have an at least substantially uniform wall thickness (extending between the interior of the container 1 and the exterior surface of the container 1) of at least approximately 0.01 inches to 0.05 inches (e.g., between about 0.025 inches to 0.035 inches). Accordingly, the sidewall 200 may have an at least substantially uniform wall thickness between the curved base transition region 220, vertical portion 210, and top portions 300 (each described in greater detail herein). However, in other embodiments, the container 1 may have a non-uniform wall thickness, such that portions of the container that are forecasted to be subject to higher loads may be formed with a greater wall thickness. Still further, in various embodiments, the container 1 may be configured to resist a vertical crushing force of between about 80-200 lbf of force with about a 0.25-inch deflection in overall height of the bottle before breaking. In other embodiments, the container 1 may be configured to resist a vertical crushing force of between about 90-120 lbf of force with about a 0.25-inch deflection in overall height of the bottle before breaking.

Figure 4:
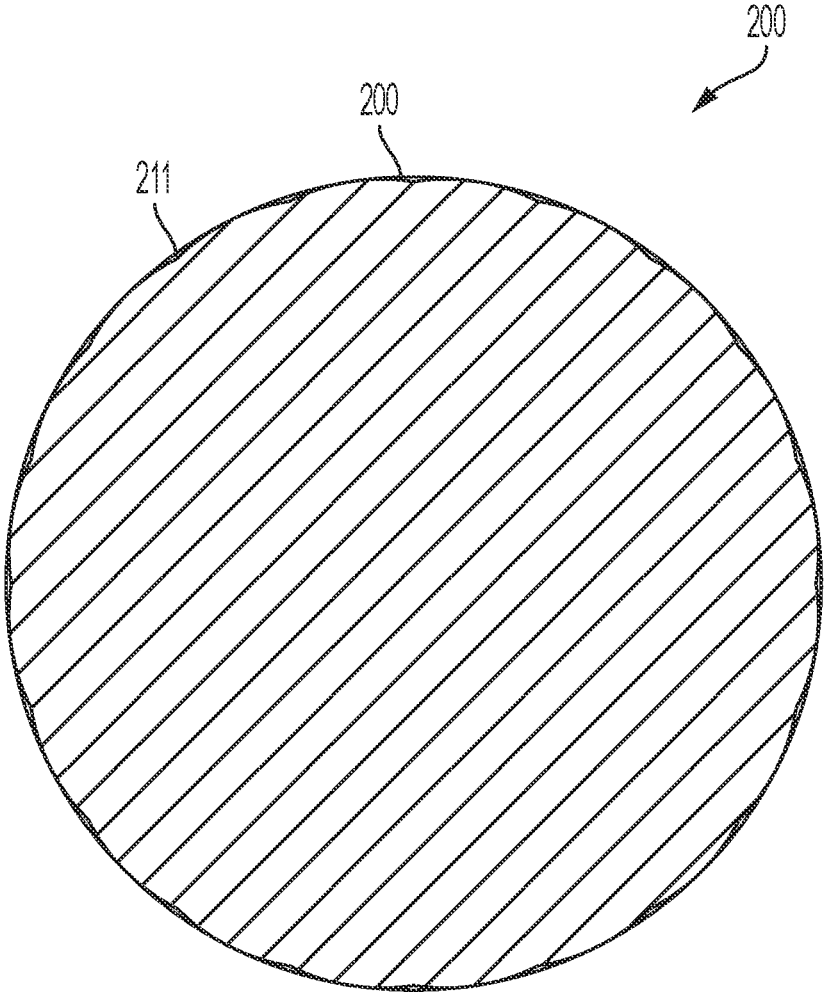
FIG. 4 shows a top sectional view of the container of FIG. 1 according to various embodiments.

As will be discussed herein with reference to specific contours of the container 1, the container 1 may define a symmetry plane A extending through the center of the container. In various embodiments, the container may be at least substantially symmetrical across the symmetry plane A (except as specifically noted elsewhere herein), such that contours on a first side of the symmetry plane A are equal and opposite to contours on a second side of the symmetry plane A. As illustrated in FIG. 4, the symmetry plane A may extend through a center of a base channel and a smooth base transition region 222. It should be understood, though, that in certain embodiments (see e.g., FIGS. 7A-C) the symmetry may be substantially different from and/or non-existent as compared to that of container 1, without departing from the scope and nature of certain inventive concepts described herein.

Base Portion 100

As illustrated in FIGS. 1-6B, a container 1 according to various embodiments may be supported in an upright configuration by a base portion 100 relative to a horizontal support surface. The base portion 100 may be defined between a base transition region 220 extending around the perimeter of the container 1. In various embodiments, the base transition region 220 may define a radius of curvature between the rounded sidewall 200 and the base portion 100 around the entire perimeter of the container 1 (with exceptions, for example, resulting from the presence of one or more channels 110 extending through the base transition region 220) extending between the base portion 100 and the container sidewall 200.

Figure 3:
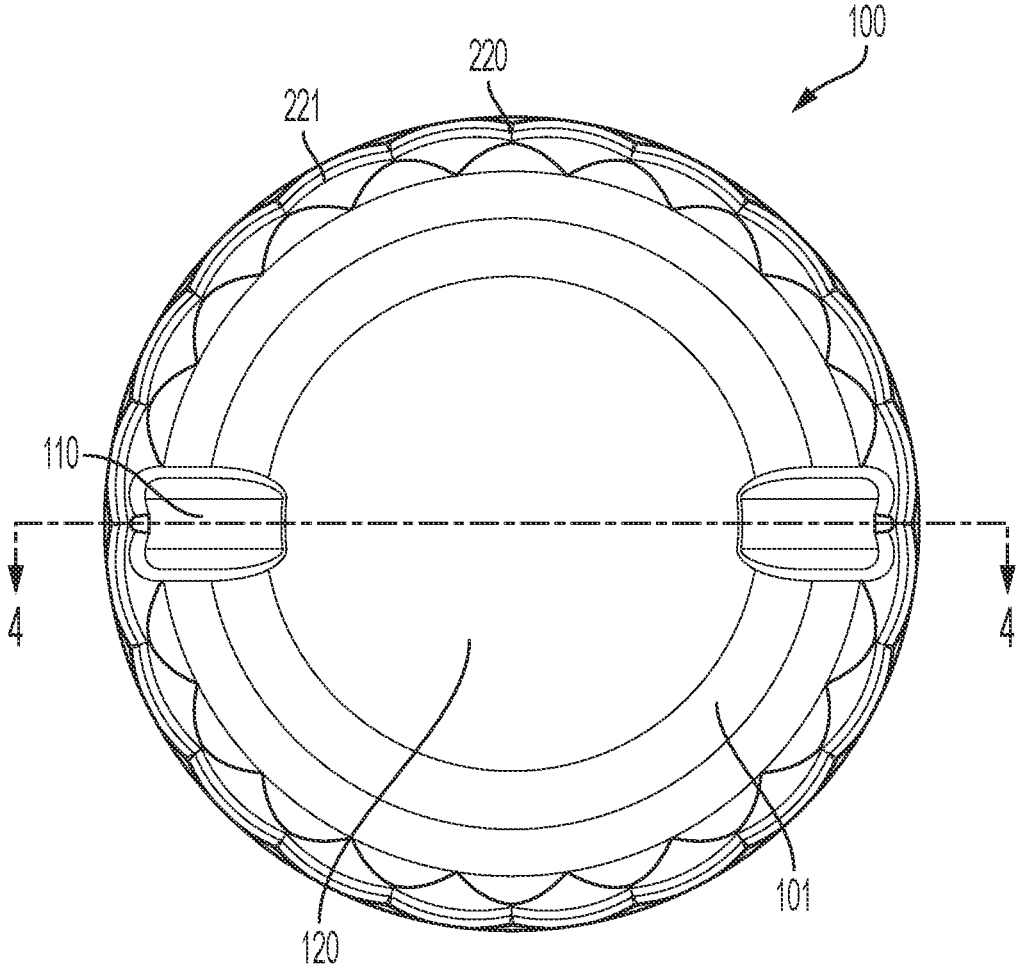
FIG. 3 shows a bottom view of the container of FIG. 1 according to various embodiments.
Figure 6A:
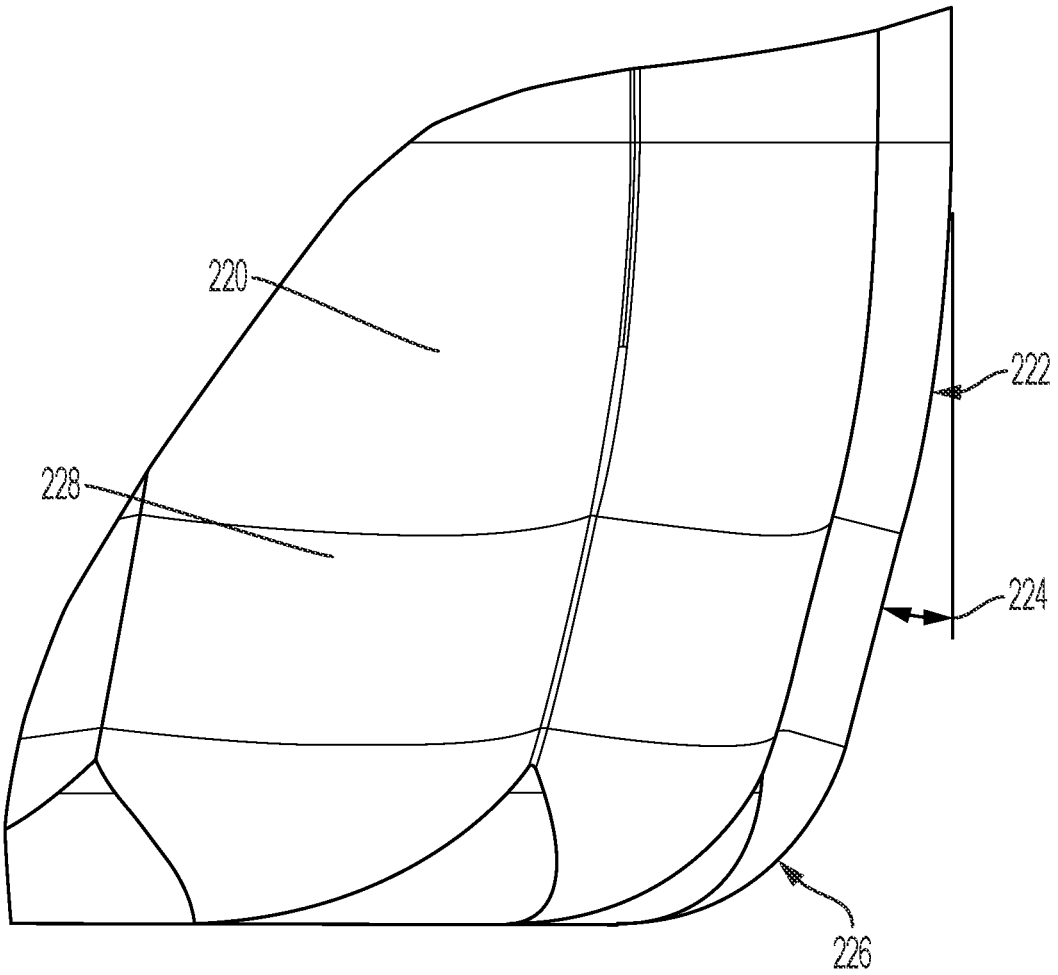
FIG. 6A shows an enlarged sectional view of a portion of the transition region of the container of FIG. 1 according to various embodiments.
Figure 6B:
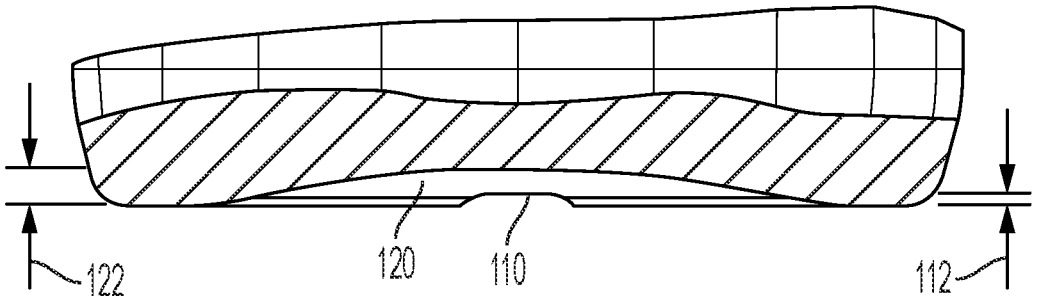
FIG. 6B shows an enlarged sectional view of a portion of the transition region and the base portion of the container of FIG. 1 according to various embodiments.

For example, as shown in FIGS. 1, 3, and 6B, the base portion 100 defines a base channel 110 extending through a support portion 101 and across the entirety of the base portion 100. The base channel 110 may be aligned with the symmetry plane A, such that a centerline of the base channel 110 is aligned with the symmetry plane A. In the illustrated embodiment of FIG. 3, the base channel 110 has a width (measured across the base channel 110 and perpendicular to the plane of symmetry A) of between 0.1 inches to 1.0 inches (e.g., 0.532 inches). The base channel 110 may have a depth of between 0.01 inches to 0.08 inches (e.g., 0.040 or 0.056 inches). In other embodiments, no base channel 110 may be provided. The base channel 110, when present, may also define an at least substantially continuous, concave radius of curvature of between about 0.01 inches to 0.25 inches (e.g., 0.1 inches). In various embodiments, the base channel 110 may have an at least substantially uniform wall thickness of at least approximately 0.01 inches to 0.05 inches (e.g., between about 0.025 inches to 0.035 inches). Because the base channel 110 intersects the support portion 101 across the entirety of the diameter of the base portion 100, the support portion 101 effectively forms two symmetrical support portions on which the container 1 is supported in an upright orientation. Each of the symmetrical support portions of the support portion 101 may form substantially "C"-shaped support portions, having opposite ends of each support portion bounded by each of the base channels 110.

With reference to FIG. 6B, it may be understood that the base channel 110, shown in sectional view, may define a tunnel 112. This tunnel 112, as previously described, may intersect the support portion 101 across the entirety of the diameter of the base portion 100. The tunnel 112 may also intersect the transition region 220. A depth of the tunnel 112 may be between 0.01 and 0.20 inches (e.g., approximately 0.056 inches, or 0.10 inches or the like). The range of depths for the tunnel 112 may of course vary beyond the ranges stated above in certain embodiments, provided of course that the depth of the tunnel 112 remains less than a depth 122 of an adjacent inset panel 120, as described immediately below and as evident also from FIG. 6B.

With reference once more to FIGS. 3 and 6B collectively, as mentioned, the base portion 100 may in certain embodiments also define an inset panel 120 circumscribed by the support portion 101. As illustrated, the inset panel 120 may comprise an at least substantially rounded panel inset relative to the support portion 101 toward the interior of the container. The at least substantially rounded inset panel 120 may be flat or concave, having a center point that is inset toward the interior of the container 1 relative to the edges of the inset panel 120 (i.e., the edges of the inset panel 120 may be provided within a single horizontal plane). In various embodiments, the center point of the inset panel 120 may be inset by a depth 122 of between about 0.1 inches to 0.25 inches (e.g., 0.159 inches) relative to the edges of the inset panel 120. Moreover, the edges of the inset panel 120 may be inset relative to the support portion 101 by a depth 122 of between about 0.1 inches to 0.4 inches (e.g., 0.2 inches). The edge depth may of course vary relative to the center point depth and the inset panel 120 may be gradually inset relative to the support portion 101 to vary the interior volume of the container 1. Accordingly, the inset distance may be set according to a desired interior volume of the container 1. The distance of inset of the panel 120 relative to support portion 101 is also, in certain embodiments, generally greater than the distance of inset or depth of the tunnel 112 of the base channel 110.

In various embodiments, the outer edge of the inset panel 120 may define a transition curvature to the support portion 101 and may have a radius of curvature of at least about 5.0 inches to 20.0 inches (e.g., 13.52 inches). In other embodiments, the radius of curvature may range from between 1.0 inch to 25.0 inches. In various embodiments, the inset panel 120 may have an at least substantially uniform wall thickness of at least approximately 0.01 inches to 0.05 inches (e.g., between about 0.025 inches to 0.035 inches). The inset panel 120 may be centrally located within the base portion 100 (e.g., such that a centerpoint of the inset panel 120 is aligned with a central axis 11 of the container 1) and may have a shape corresponding to the at least substantially rounded shape of the container 1. In such embodiments, the support portion 101 has an at least substantially uniform width around the perimeter of the base portion 100. It should be understood, of course, that the inset panel 120 may in certain embodiments (see e.g., FIGS. 7A-C) be located in an offset manner within an analogous or differently shaped base portion.

Returning to FIG. 3 particularly, it should be evident that because the inset panel 120 is located centrally within the support portion 101 of the container 1, the inset panel 120 segments the base channel 110, causing the channel to manifest into two portions positioned on opposite sides of the inset panel 120 and aligned with the plane of symmetry A.

Rounded Sidewall 200

In the illustrated embodiment of FIGS. 1-6A, the container 1 defines a rounded sidewall 200 extending between the base portion 100 and the rim portion 300 along a central axis 11. The rounded sidewall 200 further defines a vertical portion 210 and a curved base transition region 220. The curved base transition region 220 extends between the base portion 100 and the vertical portion 210. The vertical portion 210 extends between the curved base transition region 220 and the rim portion 300. The vertical portion 210 may be defined by portions of the sidewall 200 having an at least substantially vertical orientation (while the container 1 is in the upright configuration). As shown in the embodiment of FIGS. 1-6A, the portions of the container sidewall 200 within the vertical portion 210 may have a rounded configuration corresponding to the rounded shape of the base portion 100 and base transition region 220. The vertical portion 210 and the curved base transition region 220 are arranged concentrically so as to extend along the central axis 11. In some embodiments (see e.g., the container 702 of FIG. 7A), the cross-sectional diameter of the vertical portion 210 may be smaller than an adjacent portion of the base transition region 220 and/or rim portion 300, thereby providing an inset vertical portion 210. In various embodiments, the vertical portion 210 may have an at least substantially uniform wall thickness of at least approximately 0.01 inches to 0.05 inches (e.g., between about 0.025 inches to 0.035 inches).

The vertical portion 210 may be configured for accepting a label printed, adhered, or otherwise secured thereon. For example, a separate label having a circumference at least substantially identical to the circumference of the vertical portion 210 may be positioned over a portion of the vertical portion 210 of the container 1. Because, in various embodiments, the vertical portion 210 may define a vertical inset portion (not shown) positioned inset relative to adjacent portions of the container, the separate label need not be directly secured onto the container sidewalls 200, and may be retained on the vertical portion 210 due to the relative size of the label (having a circumference substantially similar to the circumference of the vertical inset portion 210) relative to the sizes of the container portions immediately adjacent the vertical portion 210. For example, the label may be free to rotate around the vertical portion 210. In those embodiments wherein the vertical portion 210 defines one or more grooves or flutes 211 (described in further detail immediately below), a portion of the vertical portion may have a smooth surface 212 (see FIG. 1; see also smooth surface 712 of container 710, illustrated in FIG. 7B). The smooth surfaces 212, 712 may also be configured for receipt of a label or other identifying (e.g., etched or printed) content on the container(s).

Figure 2:
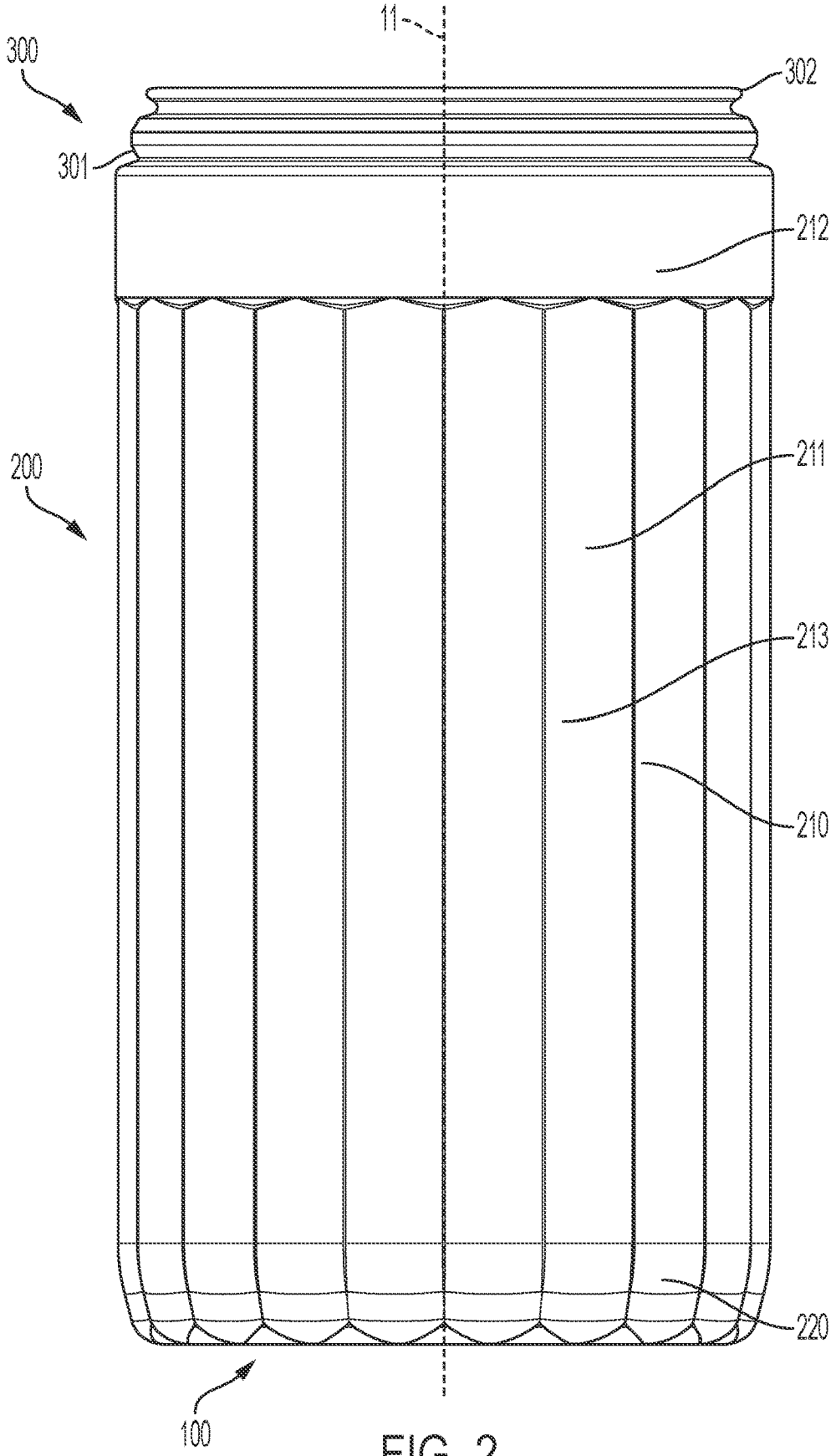
FIG. 2 shows a side view of the container of FIG. 1 according to various embodiments.

As shown in FIGS. 1-2 and 4-5, in various embodiments, one or more sets of grooves 211 may be defined within the vertical portion 210 of the rounded sidewall 200 to provide increased vertical crush resistance to the container 1. In various embodiments, for example, as illustrated in the embodiment shown in FIGS. 1-2 and 4-5, the one or more sets of grooves (or flutes) 211 comprises a plurality of grooves extending along the vertical portion 210 in a substantially vertical orientation such that each of the grooves 211 runs parallel to the central axis 11 of the tubular body 10. As depicted, each groove 211 is of substantially similar length and width and is oriented at a different point around the perimeter of the vertical portion 210 such that the grooves are separated by substantially the same distance. For example, as shown in FIGS. 1 and 2, the grooves 211 may be at least substantially adjacent one another, with minimal spaces therebetween such that the minimal space between two adjacent grooves forms a thin rib. In other embodiments, smooth surfaces 212 may be provided intermediate spaced apart respective grooves 211, as may be desirable for labeling and/or structural purposes.

The plurality of grooves 211 may comprise between 15 and 25 individual grooves (e.g., eighteen or twenty grooves). In various embodiments, the plurality of grooves 211 may have a length extending between the bottom and the top of the vertical portion 210. In other embodiments, one or more of the plurality of grooves 211 may have a length less than the vertical portion (see e.g., FIGS. 7A-C). The plurality of grooves 211 may also, in certain embodiments, have an at least substantially continuous depth 206 (e.g., measured between the surface of the rounded sidewall 200 in which the grooves 211 are disposed and an innermost surface of the grooves 211 positioned within the thickness of the rounded sidewall 200 and toward the interior surface of the rounded sidewall 200) along the length of the grooves 211. In various embodiments, this depth 206 (see FIG. 5) may be between 0.01 and 0.50 inches. In other embodiments, this depth 206 (see FIG. 5) may be between 0.01 and 0.08 inches (e.g., 0.040 inches). In still other embodiments, this depth 206 (see FIG. 5) may be greater than 0.50 inches, limited only by a diameter of the container.

The plurality of grooves 211 may also have an at least substantially continuous width. In various embodiments, the respective width of each of the grooves may be substantially smaller than the respective length of the same groove. Moreover, the grooves 211 may have a rounded inner surface having an at least substantially continuous radius. The substantially continuous radius or radius of curvature 204 (see FIG. 5) may be between 0.25 and 2.0 inches in certain embodiments; in other embodiments, the curvature 204 may be between 0.75 and 0.95 inches (e.g., 0.850 inches). The grooves 211 may also have a continuous width measured perpendicular to the length of the grooves 211. In certain embodiments, the grooves 211 may have a width of between 0.15 and 0.50 inches; between 0.10 and 0.30 inches; and/or between 0.20 and 0.25 inches (e.g., 0.2125 inches). Finally, the grooves 211 may have a transition radius between the sidewall 200 and the grooves 211. However, it should be understood that in various embodiments, the depth, width, inner surface radius, and/or transition radius may vary along the length of the grooves 211 and/or between respective ones of the grooves 211.

In various embodiments, the respective grooves in the first set of grooves 211 are oriented at different points around the perimeter of the vertical portion 210 such that the grooves 211 are separated by substantially the same distance. In such a configuration, the respective grooves 211 are positioned adjacent and parallel to one another to create a groove grid defining a plurality of thin vertical ribs 213 (see FIG. 2) positioned between the lengths of adjacent grooves 211 in the vertical portion 210. The groove grid may, in certain embodiment, extend continuously around the entirety of the perimeter of the vertical portion 210 of the rounded sidewall 200. In other embodiments, the groove grid may extend only partially and/or intermittently (i.e., not continuously) around a portion of or the entirety of the perimeter of the vertical portion 210. The height of the groove grid may be defined by the length of the grooves 211 arranged in a vertical orientation.

With reference to FIGS. 1-3 and 6A-B, in various embodiments, the rounded sidewall 200 further defines the curved base transition region 220 extending around the perimeter of the container 1. The base transition region 220 may define a substantially continuous radius around the entire perimeter of the container 1 (with exceptions, for example, resulting from the presence of one or more base channels 110 extending through the base transition region) extending between the base portion 100 and the vertical portion 210. As just one non-limiting example, the base transition region 220 may comprise two distinct radii: a first radius 222 of at least approximately 1.4 inches to 1.6 inches (e.g., 1.523 inches) positioned tangent to the vertical portion 210 and a second radius 226 of at least approximately 0.25-0.5 inches (e.g., 0.346 inches) positioned tangent to the support portion 101. In various embodiments, the second radius may be 20%-50% the value of the first radius. In various embodiments, In certain embodiments, the first radius 222 may be offset relative to the axis 11 or the vertical portion 210 by an angle 224. The angle 224 may range from 10 to 20 degrees (e.g., 15 degrees). In certain embodiments, the first and second radii 222, 226 may be expressed as radii of curvature (rather than lengths), with the first being in the range of 0.20 to 0.40 inches (e.g., 0.29 inches) and the second being in the range of 0.10 and 0.30 inches (e.g., 0.204 inches).

In various embodiments, the transition from the first radius to the second radius occurs at a distance of at least approximately 0.6-0.9 inches (e.g., 0.77 inches) measured vertically from the support surface 101. In certain embodiments, the curved base transition region 220 may also have a height of at least approximately 0.475 inches to 0.775 inches (e.g., 0.760 inches). In various embodiments, the curved base transition region 220 may have an at least substantially uniform wall thickness of at least approximately 0.01 inches to 0.05 inches (e.g., between about 0.025 inches to 0.035 inches).

In various embodiments, the base transition region 220 may define one or more base transition grooves 228 following the length of a radius of the base transition region 220. In the illustrated embodiment of FIGS. 1-3 and 6A, the base transition grooves 228 may extend between the vertical portion 210 of the rounded sidewall and the support portion 101 (as discussed herein). The one or more base transition grooves 228 may be arranged around the perimeter of the curved base transition region 220 such that adjacent grooves are separated by substantially the same distance. The base transition grooves 228 may have a rounded depth profile or a planar surface. The base transition grooves 228 may have a depth to the deepest point of the groove of at least approximately 0.01-0.1 inches (e.g., 0.03 inches). The base transition grooves 228 may each have an at least substantially uniform depth along the respective lengths of the base transition grooves. Moreover, in various embodiments the base transition grooves 228 may have either a sharp transition (i.e. the surface of the curved base transition region and the inner wall of the base grooves form a 90-degree angle) or a curved transition from the base transition region 220 into the base transition grooves having a radius of at least approximately 0.001-0.1 inches (e.g., 0.02 inches). In various embodiments, the grooves 228 may have sidewalls extending between the curved base transition region 220 to the depth profile radius at an angle relative to a symmetry line of the groove 228 of at least approximately 25-85 degrees (e.g., 55 degrees).

In the illustrated embodiments of FIGS. 1 and 3, the base transition grooves 221 may have an equal length of at least approximately 0.3-0.75 inches (e.g., 0.673 inches) and an equal width of at least approximately 0.1-0.3 inches (e.g., 0.2 inches). However, it should be understood that various base transition grooves 228 may have lengths, depths, and/or other configurations different from other base transition grooves 228. It should also be understood that various base transition grooves 228 may be seamless extensions of and/or otherwise substantially adopt the dimensions and characteristics of the grooves or flutes 211 provided on the vertical portion 210 of the container 1.

Although not illustrated, in various embodiments, the curved base transition region 220 may further define at least two opposing smooth transition regions that are void of any of the one or more base transition grooves 228. As a non-limiting example, the at least two opposing smooth transition regions may extend between the vertical portion 210 of the rounded sidewall and the support portion 101 and be positioned adjacent the opposing (or otherwise provided) base channels 110.

Rim Portion 300

In various embodiments, the rim portion 300 extends above the vertical portion 210 and forms an opening 12 from which the contents of the container 1 may be added to the container and/or removed from the container 1. The rim portion 300 may define a shoulder 301 intersecting the top of the vertical portion 210 (and/or the smooth surface 212 of the vertical portion) and extending at least substantially vertically between the vertical portion 210 and a lid engagement portion 302.

In various embodiments, the lid engagement portion 302 may define one or more threads, nipples, and/or the like to engage a removable lid (not shown) such that the removable lid may be selectably secured to the container 1. The lid engagement portion 302 may be configured for an interference fit with the removable lid. In various embodiments, the height of the rim portion (measured vertically) may be at least approximately 0.517 inches to 0.547 inches (e.g., about 0.532 inches). The outer diameter of the rim portion 300 may be smaller than the diameter of the vertical portion 210, such that a removable lid may be aligned with the vertical portion to provide a smooth fit flush with the vertical portion. For example, the outer diameter of the rim portion 300 may be at least approximately 4.11 inches to 4.14 inches (e.g., about 4.125 inches). In various embodiments, one or more portions of the rim portion 300 may have a wall thickness greater than the wall thickness of remaining portions of the container 1. Particularly in embodiments comprising a lid engagement portion 302, the rim portion 300 may not be symmetrical across the container symmetry plane A.

Moreover, in certain embodiments, the rim portion 300 may be configured to provide additional rigidity to the container 1 while a cap is secured thereto. Accordingly, the container 1 may have a higher crush resistance strength while the cap is secured relative to the rim portion 300.

In various embodiments, the rim portion 300 may be located at least substantially centrally with respect to the profile of the container 1. As shown in FIGS. 1-3, the rim portion 300 may be centrally located relative to the container 1, such that a centerline of the rim portion 300 is at least substantially aligned with the central axis 11 of the container 1 and a centerline of the base portion 100.

In various embodiments, the inner perimeter of the lid engagement portion 302 may define the perimeter of an open end of the container 1. The open end is arranged opposite the base portion 100. The open end may be substantially circular, symmetric across symmetrical plane A, and centered on the symmetrical axis 11. It may also be otherwise positioned, as may be understood with reference to the additional embodiments of FIGS. 7A-C.

Additional Embodiments

Throughout herein various features including a base portion 100, a vertical portion 200, and a rim portion 300 have been described largely with reference to a container 1, as illustrated in FIG. 1. It should be understood, however, that at least certain of the features within each of these portions 100, 200, 300 may be reproduced and/or otherwise placed upon other containers, without departing from the scope and nature of the inventive concepts described and covered herein.

Figure 7C:
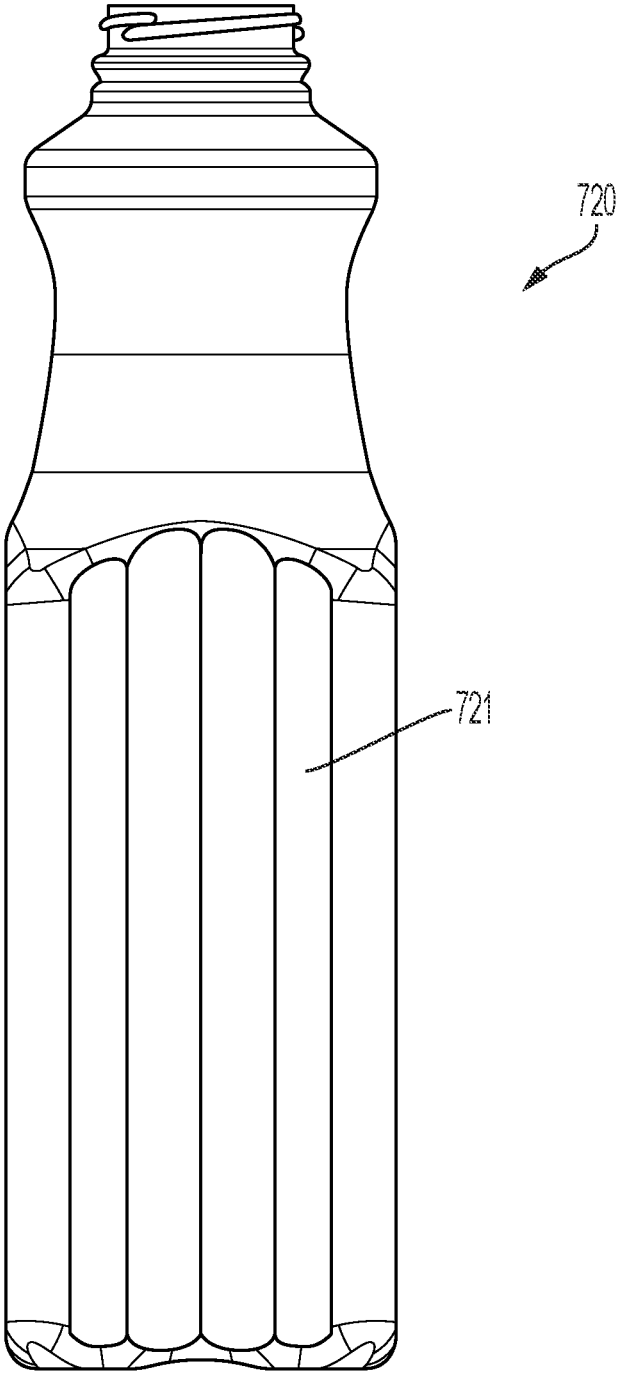

Reference is thus made to FIGS. 7A-C, wherein three additional and exemplary (i.e., non-limiting) embodiments of containers 700, 710, 720 are illustrated. Container 700 may be understood best as a column-like shaped container, whose width may differ from its depth, such that its base may be oval or otherwise irregularly shaped (i.e., not cylindrical like the base portion 100 of container 1). It should be understood, however, that other features of container 700, including the illustrated grooves 711 may be substantially the same as the analogous features described with respect to container 1, whether in terms of shape and/or size and/or relative dimensioning.

FIG. 7B illustrates another container 710, wherein a gallon (or half-gallon or quart) sized container, which might be used for storage of a fluid such as bleach or milk, is provided. In this particular embodiment, no grooves may be provided on the vertical portion, instead having thereon a substantially smooth surface 712, comparable to smooth surface 212 described elsewhere herein. Provided, though, are transition region-located grooves 728, which should be understood as substantially the same as the grooves 228 described and located on the transition region 220 of container 1. Of course, the transition region-located grooves 728 of container 710 may, in certain embodiments (not illustrated), extend partially onto (i.e., upward) the vertical portion (see, by way of analogy, vertical portion 210). It should be understood that the grooves 728 need not cover all of the transition region or the vertical portion, instead being intermittently or otherwise located for structural and/or aesthetic (e.g., labeling) purposes.

FIG. 7C illustrates yet another container 720, wherein a square quart decanter shape is provided, along with yet another embodiment of grooves 721 that extend only along a portion of a vertical portion of the container. As illustrated, each groove 721 may, in certain embodiments, have a length different than respectively adjacent grooves, so as to conform extremities of each groove to adjacently positioned contouring of the container 720. Any of a variety of options in this regard may be envisioned, utilized in conjunction with transition region grooves or separately therefrom (as illustrated).

Method of Manufacture

Figure 8A:
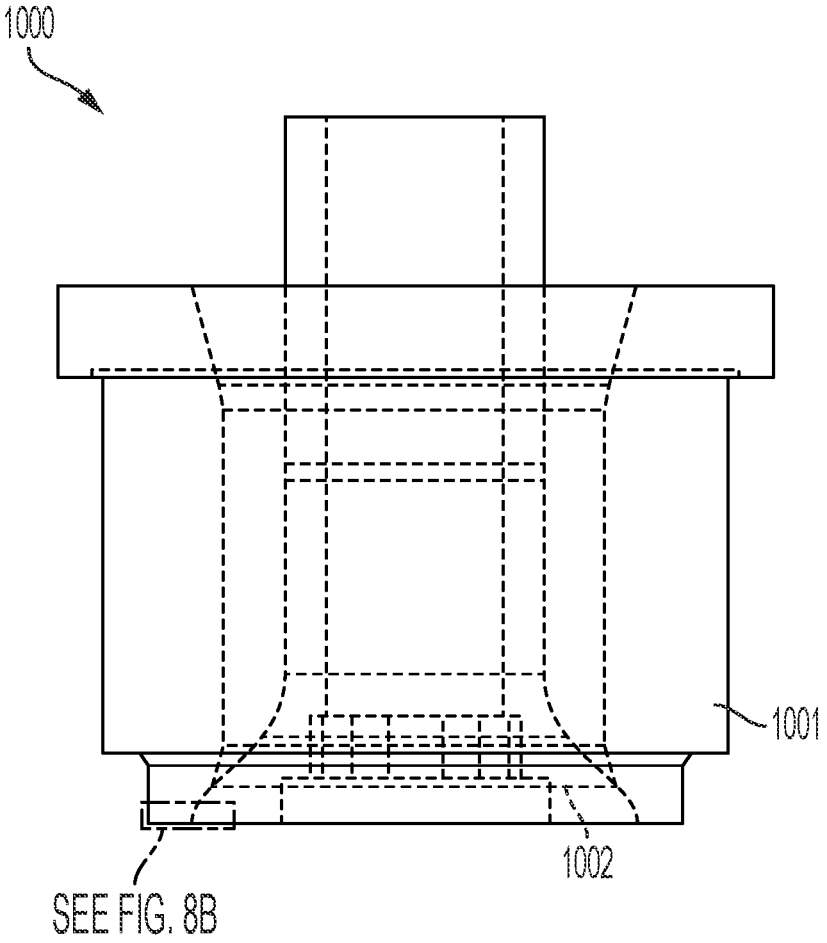
FIGS. 8A-B show various aspects of a head tool utilized in generating the container of FIG. 1 and/or the containers of FIGS. 7A-C according to various embodiments.
Figure 8B:
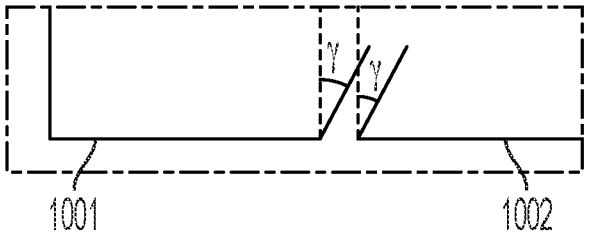

As mentioned, a container according to various embodiments may be manufactured via extrusion blowmolding. Accordingly, a parison of molten plastic may be placed within a mold, secured relative to a head tool 1000 (as shown in FIGS. 8A-B). As shown in the illustrated embodiments of FIGS. 8A-B, the head tool 1000 may comprise a die 1001 and a mandrel 1002 positioned within the die 1001. In the illustrated embodiment of FIGS. 8A-B, the die 1001 may comprise a hollow central aperture within which the mandrel 1002 may be positioned.

As shown in FIGS. 8A-B, the mandrel 1002 is positioned within the die 1001 and spaced apart therefrom. The mandrel 1002 may be concentric with the die 1001 and may have a smaller outer diameter than the inner diameter of the die 1001. Further, the mandrel 1002 and the die 1001 may comprise different shapes (e.g., a substantially ovular mandrel concentric with a substantially circular die) in order to disperse molten plastic of the parison to minimize the thickness of a partline formed in the blowmolded container (as a result of the joining of two mold shells). Accordingly, the mandrel 1002 may be spaced a distance from the die 1001. For example, the mandrel 1002 may be spaced at least about 0.09-0.12 inches (e.g., 0.115 inches) from the die 1001. As mentioned above, in various embodiments the space between the die and the mandrel may be intentionally variant around the die-mandrel interface in a number of complex geometries in order to control the wall thickness so as to maximize the crush resistance of a container. Moreover, as shown in FIG. 8B, the interior surface of the die 1001 may form an angle x with respect to vertical. Similarly, the exterior surface of the mandrel 1002 may form an angle y with respect to vertical. In various embodiments, x and y may be equal, however in certain embodiments, x and y are not equal. As a non-limiting example, x may be at least about 30 degrees and y may be at least about 32 degrees.

The molten plastic material may be injected into the head tool 1000, wherein it may then be selectively extruded from the head tool 1000 through the gap formed between the die 1001 and the mandrel 1002 to create the parison. The mandrel 1002 and the die 1001 may be configured so as to disperse the molten plastic material in such a way that the portion of the inflated parison along the partline of the mold is of substantially uniform thickness to the rest of container 1. The partline of the mold may be positioned along a plane of symmetry of the container 1.

In various embodiments, parison programming may be utilized to selectively control the configuration of mandrel 1002 and the die 1001 so as to control the thickness of the parison. By widening the gap between the mandrel 1002 and the die 1001 during the extrusion of the parison, the thickness of the parison may be selectively increased throughout a desired section. Conversely, by decreasing the gap between the mandrel 1002 and the die 1001 during the extrusion of the parison, the thickness of the parison throughout a desired section may be selectively decreased. Parison programming may be utilized in various embodiments to reduce the amount of molten plastic material used, create a substantially uniform thickness through the container 1 or to selectively distribute thickness to particular locations of container 1 that may be particularly susceptible to crushing loads or failures. The extruded parison may be placed within the mold.

Once sufficient material is positioned within the mold (e.g., 52.5 g for a 64 oz container 1), the parison may be inflated by injecting air through the center of the mandrel 1002, causing the parison to inflate and contour to the interior shape of the mold. The mold may have a shape corresponding to the shape of the container 1. As discussed herein, various portions of the container 1, such as the rounded sidewall 200, may be configured to facilitate molten material flow within the mold to enable generation of a container 1 with an at least substantially uniform wall thickness.

After inflating the parison to conform to the interior surface of the mold, the molten material may cool and harden to form the container 1. After the container has sufficiently hardened, the mold may be opened (e.g., by displacing two symmetrical mold halves away from one another (e.g., joining at a portion aligned at least substantially with the container symmetry plane A where the location of the joined portion defines the partline of the container 1). The container 1 may be removed from the mold and/or head tool 1000.

CONCLUSION

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A container comprising:

a tubular body having a longitudinal axis and a rounded sidewall extending between a first end and an opposite end surrounded by a rim portion;

a base portion defined, in part, by the first end and configured to support the container in an upright orientation relative to a support surface, the base portion further defining a support ring having an at least substantially rounded perimeter;

a rim portion defined, in part, by the opposite end and positioned opposite the base portion;

a vertical portion defined, in part, by the rounded sidewall, having a vertical portion length aligned along the longitudinal axis, and extending between the perimeter of the base portion and the rim portion, the vertical portion having a first diameter that defines a vertical portion perimeter;

a plurality of grooves confined within the vertical portion of the rounded sidewall and extending around an entirety of the vertical portion perimeter, each of the grooves comprising a groove width extending transverse to the longitudinal axis and defining opposing sides of each of the plurality of grooves, a groove length extending parallel to the longitudinal axis, greater than the groove width, and defining opposing ends of each of the plurality of grooves, a rounded inner surface extending the groove length, having a continuous convex radius, and defining a depth of each of the plurality of grooves intermediate the opposing sides, the groove length being less than the vertical portion length; and a smooth surface also confined within the vertical portion of the rounded sidewall, positioned intermediate the plurality of grooves and the rim portion, aligned with the vertical portion perimeter, and having a smooth surface length equal to a difference between the vertical portion length and the groove length, wherein:

each of the plurality of grooves is aligned parallel with the longitudinal axis;

the depth of each of the plurality of grooves is such that each of the plurality of grooves is radially inset a distance from the vertical portion perimeter;

an edge of the smooth surface defines a first of the opposing ends of each of the plurality of grooves nearest the rim portion; and opposing sides of adjacently positioned ones of the plurality of grooves define a peak that is radially aligned with the vertical portion perimeter.

2. The container of claim 1, wherein the rounded sidewall defines an at least substantially uniform wall thickness through the vertical portion.

3. The container of claim 1, wherein the rounded sidewall further defines a curved base transition region extending between the base portion and the vertical portion.

4. The container of claim 3, wherein the curved base transition region defines one or more base transition grooves arranged around the perimeter of the curved base transition region, extending at least partially between the base portion and the vertical portion, and spaced along the perimeter of the base portion.

5. The container of claim 3, wherein the one or more base transition grooves are aligned with respective ones of the plurality of grooves defined within the vertical portion of the rounded sidewall.

6. The container of claim 5, wherein the plurality of grooves defined within the vertical portion and the one or more base transition grooves are arranged around a perimeter of the vertical portion and the curved base transition region, respectively.

7. The container of claim 3, wherein a portion of the vertical portion is inset relative to the curved base transition region.

8. The container of claim 1, wherein the base portion defines a base channel extending across the base portion and aligned with a diameter of the base portion, wherein the base channel has a depth extending toward an interior of the container.

9. The container of claim 8, wherein:

the rounded sidewall further defines a curved base transition region extending between the base portion and the vertical portion;

the curved base transition region defines one or more base transition grooves arranged around the perimeter of the curved base transition region, extending at least partially between the base portion and the vertical portion, and spaced along the perimeter of the base portion; and the base channel extends along the diameter of the base portion and at least partially intersects a portion of one or more of the one or more base transition grooves.

10. The container of claim 8, wherein the base portion defines a rounded inset panel oriented such that a centerline of the rounded inset panel is aligned with base portion, wherein the depth of the base channel is a first depth, and the rounded inset panel has a second depth extending towards the interior of the container, wherein the second depth is greater than the first depth.

11. The container of claim 1, wherein:

the rim portion is oriented, relative to the longitudinal axis of the tubular body, in alignment with the base portion, the rim portion comprises an inner perimeter defining an at least substantially rounded perimeter of an opening, and the opening is oriented, relative to the longitudinal axis of the tubular body, in alignment with the base portion.

12. The container of claim 4, wherein adjacent ones of the plurality of grooves on the vertical portion and the one or more base transition grooves are each separated by substantially the same distance along respective lengths of the grooves.

13. The container of claim 8, wherein the grooves of at least two of the base transition grooves are configured to intersect the base channel.

14. A container comprising:

a tubular body having a longitudinal axis and a rounded sidewall extending between a first end and an opposing second end;

the first end is configured to support the container in an upright orientation relative to a support surface;

a vertical portion defined, in part, by the rounded sidewall, having a vertical length aligned along the longitudinal axis, extending between the first and second ends, and having a vertical portion perimeter;

a plurality of grooves confined within the vertical portion of the rounded sidewall and extending around an entirety of the vertical portion perimeter, each of the grooves comprising a groove width extending transverse to the longitudinal axis and defining opposing sides of each of the plurality of grooves, a groove length extending parallel to the longitudinal axis, greater than the groove width, and defining opposing ends of each of the plurality of grooves, a rounded inner surface extending the groove length, having a continuous convex radius, and defining a depth of each of the plurality of grooves intermediate the opposing sides, the groove length being less than the vertical portion length; and a smooth surface also confined within the vertical portion of the rounded sidewall, positioned intermediate the plurality of grooves and the rim portion, aligned with the vertical portion perimeter, and having a smooth surface length equal to a difference between the vertical portion length and the groove length, wherein:

each of the plurality of grooves extends along the longitudinal axis;

the depth of each of the plurality of grooves is such that each of the plurality of grooves is radially inset a distance from the vertical portion perimeter;

an edge of the smooth surf ace defines a first of the opposing ends of each of the plurality of grooves nearest the rim portion; and opposing sides of adjacently positioned ones of the plurality of grooves define a peak that is radially aligned with the vertical portion perimeter.

15. The container of claim 14, wherein the sidewall defines an at least substantially uniform wall thickness through the vertical portion.

16. The container of claim 14, wherein the first end, in part, defines a base portion, and wherein the rounded sidewall further defines a curved base transition region extending between the base portion and the vertical portion.

17. The container of claim 16, wherein the curved base transition region defines one or more base transition grooves arranged around the perimeter of the curved base transition region and extending at least partially between the base portion and the vertical portion and following a length of a radius of the base portion.

18. The container of claim 17, wherein adjacent ones of the plurality of grooves on the vertical portion and the one or more base transition grooves are each separated by substantially the same distance along respective lengths of the grooves.

19. The container of claim 14, wherein the first end, in part, defines a base portion, wherein the base portion defines a base channel extending across the base portion and aligned with a diameter of the base portion, and wherein the base channel has a depth extending toward an interior of the container.

20. The container of claim 19, wherein the grooves of at least two of the base transition grooves are configured to intersect the base channel.

* * * * *